US005393445A

United States Patent [19]

Furuya et al.

[11] Patent Number: 5,393,445

[45] Date of Patent: Feb. 28, 1995

[54] RARE-EARTH BONDED MAGNET, MATERIAL AND METHOD FOR MANUFACTURING THE SAME

[75] Inventors: Takashi Furuya, Chita; Naoki Hayashi, Tohkai, both of Japan

[73] Assignee: Daido Tokushuko Kabushiki Kaisha, Nagoya, Japan

[21] Appl. No.: 176,645

[22] Filed: Jan. 3, 1994

Related U.S. Application Data

[63] Continuation-in-part of Ser. No. 996,136, Dec. 23, 1992, abandoned.

[30] Foreign Application Priority Data

Dec. 26, 1991 [JP] Japan ..... 3-345039

[51] Int. Cl.[6] ..... H01F 1/053

[52] U.S. Cl. ..... 252/62.54; 252/62.53; 252/62.51; 252/62.57; 252/62.58; 428/402; 428/403; 428/407; 428/900

[58] Field of Search ..... 252/62.54, 62.53, 62.51, 252/62.57, 62.58; 428/402, 403, 900, 407

[56] References Cited

U.S. PATENT DOCUMENTS

| | | | |
|---|---|---|---|
| 2,904,875 | 9/1959 | Trigg et al. | 252/62.54 |
| 4,973,415 | 11/1990 | Ohmachi et al. | 252/62.54 |
| 5,176,842 | 1/1993 | Kuwazawa et al. | 252/62.54 |

FOREIGN PATENT DOCUMENTS

| | | |
|---|---|---|
| 0549149 | 6/1993 | European Pat. Off. . |
| 3803538 | 8/1988 | Germany . |
| 63-24607 | 2/1988 | Japan . |
| 1-114006 | 5/1989 | Japan . |
| 2-6573 | 1/1990 | Japan . |

OTHER PUBLICATIONS

Patent Abstracts of Japan, vol. 13, No. 354 (E-802) 8 Aug. 1989.

Patent Abstracts of Japan, vol. 14, No. 344 (E-0955) 25 Jul. 1990.

Patent Abstracts of Japan, vol. 14, No. 134 (C-0701) 14 Mar. 1990.

*Primary Examiner*—Prince Willis, Jr.
*Assistant Examiner*—Alan D. Diamond
*Attorney, Agent, or Firm*—Sughrue, Mion, Zinn, Macpeak & Seas

[57] ABSTRACT

A material for a rare-earth bonded magnet is prepared by coating a rare-earth magnetic powder with a heat resisting addition polymerizable thermosetting resin consisting essentially of a monomer or polymer of 2,2-bis(cyanatophenyl) propane in an amount of not more than 2 wt % based on the weight of the magnetic powder. The oxidation of the rare-earth magnetic powder is thereby prevented or retarded by triazine rings formed in the coating film of the heat resisting addition polymerizable thermosetting resin. A rare-earth bonded magnet having improved heat resistance is prepared by agglomerating the coated rare-earth magnetic powder with a binder. The heat resistance of the bonded magnet is further improved by curing the heat resisting addition polymerizable thermosetting resin in a vacuum and by adding an organometallic salt as a metallic catalyst, to thereby improve the integrity of the coating film.

5 Claims, No Drawings

RARE-EARTH BONDED MAGNET, MATERIAL AND METHOD FOR MANUFACTURING THE SAME

CROSS REFERENCE TO RELATED APPLICATIONS

This application is a continuation-in-part of application Ser. No. 07/996,136, filed Dec. 23, 1992, now abandoned.

BACKGROUND OF THE INVENTION

1. Field of the Invention

This invention relates to a rare-earth bonded magnet used widely for industrial products such as automobiles, business machines, domestic electrification machines and sounder machines, and to a material and a method suitable for manufacturing the rare-earth bonded magnet.

2. Description of the Prior Art

Heretofore, Alnico magnet and Ferrite magnets have been widely used as permanent magnets. However, rare-earth magnets have been developed having excellent magnetic properties as compared to the aforementioned magnets, and the application and demand of rare-earth magnets has remarkably increased in recent years.

The rare-earth magnets contain active metals and are easily oxidized. Therefore, rare-earth magnets of this kind are inferior in their corrosion resistance and heat-resisting properties, especially in an air atmosphere at a temperature higher than room temperature.

Among the rare-earth magnets, R—Fe—B magnets and R—Fe—N magnets contain Fe(iron) as a main element in addition to R (rare-earth metals), and are oxidized to a considerably greater extent as compared to Sm—Co magnets. Accordingly, the R—Fe rare-earth magnets have excellent magnetic properties, however they are disadvantageous in view of their poor oxidation resistance, corrosion resistance, temperature characteristics and heat resistance at temperatures higher than room temperature.

Among the rare-earth magnets, the sintered magnet is densified by sintering. Therefore, it is possible to considerably improve the heat resistance of the sintered magnet by coating the surface of the magnet with, for example, Ni, or resin at the final stage of the magnet manufacturing process. Among the bonded magnets, especially in a magnet manufactured by injection molding using a thermoplastic resin such as polyamide resin, it is possible to improve heat resistance by coating the surface of the magnet in a manner similar to that of a sintered magnet. This is because the surface of magnetic powder is covered completely with the resin.

On the other hand, among the bonded magnets, in a magnet manufactured by compression molding using a binder such as a thermosetting resin (for example, epoxy resin), metals or the like, a large number of vacancies exist between the powdered magnetic material and the binder. Therefore, it is not possible to protect the magnet from oxidation due to the internal vacancies even if the surface of the magnet is completely coated, and oxidation of the magnetic material is unavoidable through the coating layer and the internal vacancies. Consequently, secular change of magnetic properties at room temperature and at temperatures higher than room temperature disadvantageously becomes large and the heat resistance of the magnet is degraded with the passage of time.

SUMMARY OF THE INVENTION

This invention was made in view of the aforementioned problems of the prior art. Accordingly, it is an object of this invention to provide a rare-earth bonded magnet and material for making the same exhibiting decreased secular change of magnetic properties at room temperature, and having improved heat resistance by preventing oxidation of a constituent rare-earth magnetic powder to the extent possible.

Other objects of this invention will become apparent in the following description and Examples.

The present inventors have discovered that the above objective is achieved by providing a material for a rare-earth bonded magnet comprising a rare-earth magnetic powder coated with a heat resisting addition polymerizable thermosetting resin consisting essentially of a monomer or polymer of 2,2-bis(cyanatophenyl) propane in an amount of not more than 2 wt % based on the weight of the magnetic powder.

The present inventors have also discovered that the above objective is achieved by providing a rare-earth bonded magnet prepared by agglomerating a rare-earth magnetic powder coated with a heat resisting addition polymerizable thermosetting resin consisting essentially of a monomer or polymer of 2,2-bis(cyanatophenyl) propane in an amount of not more than 2 wt % based on the weight of the magnetic powder together with a binder.

The rare-earth bonded magnet according to this invention comprises a rare-earth magnetic powder coated with a heat resisting addition polymerizable thermosetting resin consisting essentially of a monomer or polymer of 2,2-bis(cyanatophenyl) propane in an amount of not more than 2 wt % based on the weight of the magnetic powder. The rare-earth bonded magnet may further comprise a binder as needed. In this case, the coated magnetic powder is agglomerated together with a binder.

The method of preparing the rare-earth bonded magnet of this invention comprises the steps of coating a surface of a rare-earth magnetic powder with a heat resisting addition polymerizable thermosetting resin consisting essentially of a monomer or polymer of 2,2-bis(cyanatophenyl) propane by adding the same to a rare-earth magnetic powder concurrent with or followed by addition of a binder (as needed), subsequently molding a compact by pressing the rare-earth magnetic powder coated with the heat resisting addition polymerizable thermosetting resin together with the binder, and curing the heat resisting addition polymerizable thermosetting resin in the compact. An organometallic salt as a metallic catalyst may be added together with the binder and the heat resisting addition polymerizable thermosetting resin in a preferred embodiment, and curing of the heat resisting addition polymerizable thermosetting resin may be carried out at a temperature of not lower than 150° C. in a vacuum or in an atmosphere of argon in other preferred embodiments.

It is to be understood that both the foregoing general description and the following detailed description are exemplary and explanatory but are not to be construed as being restrictive of the invention.

DETAILED DESCRIPTION OF THE INVENTION

In the present invention, a magnetic powder containing rare-earth metals such as R—Fe , R—Fe—B, R—Fe—N and the like is used as the rare-earth magnetic powder.

As the resin to be coated on the surface of the rare-earth magnetic power, a heat resisting addition polymerizable thermosetting resin is used consisting essentially of a monomer or polymer of 2,2-bis(cyanatophenyl) propane in an amount of not more than 2 wt % and preferably in an amount of from 0.01–1.00 wt % based on the weight of the magnetic powder.

The heat resisting addition polymerizable thermosetting resin for use in this invention is commercially available from MITSUBISHI GAS CHEMICAL COMPANY, LTD., Tokyo, Japan (No. 5-2, Marunochi 2-chome, Chiyoda-ku, Tokyo) as "Triazine A Monomer BT 2000".

| TRIAZINE A MONOMER BT 2000 | | |
|---|---|---|
| 1. | Chemical Name | 2,2-bis (cyanatophenyl) propane |
| 2. | Chemical structure | |
| | Molecular weight | 278 |
| | Specific gravity | 1.121 (90° C.) |
| | Specific Heat | 0.31 kcal/kg |
| | Flash point | 258° C. |
| | Ignition point | 500° C. and higher |
| 3. | TSCA Number | 25722-66-1 |
| 4. | Properties of BT 2000 | |
| | 4.1 Appearance | White flake |
| | 4.2 Melting point | 76~81° C. |
| | 4.3 Purity | 94% upper |
| | 4.4 Color | 1~6 (90° C., Gardner) |

The heat resisting addition polymerizable thermosetting resin of the invention consists essentially of a monomer or polymer of 2,2-bis(cyanatophenyl) propane. Most preferably, the heat resisting polymerizable thermosetting resin consists of a monomer or polymer of 2,2-bis(cyanatophenyl) propane.

In a preferred embodiment, the rare-earth magnetic powder is coated exclusively, just with a monomer or polymer of 2,2-bis(cyanatophenyl) propane. Namely, in this preferred embodiment, the rare-earth magnetic powder has a coating consisting of a monomer or polymer of 2,2-bis(cyanatophenyl) propane. Furthermore, the resin coating, binder and rare-earth bonded magnet of this invention preferably do not comprise a thermosetting polyimide resin such as bismaleimide, or a triazine resin modified to have a dithiol group such as dibutyl amino triazine dithiol, or an aminotriazine-aldehyde resin For coating, various methods may be applied, such as a method of coating the rare-earth magnetic powder by dipping it into a solution (for example, methyl ethyl ketone is used as a solvent) containing the heat resisting addition polymerizable thermosetting resin consisting essentially of a monomer or polymer of 2,2-bis(-cyanatophenyl) propane, a method of mixing the rare-earth magnetic power after adding thereto the heat resisting addition polymerizable thermosetting resin consisting essentially of a monomer or polymer of 2,2-bis(cyanatophenyl) propane, and a method of coating the rare-earth magnetic powder by vaporizing the heat resisting addition polymerizable thermosetting resin consisting essentially of 2,2-bis(cyanatophenyl) propane and depositing it on the surface of the magnetic powder, for example.

The rare-earth bonded magnet of this invention is formed by agglomerating a rare-earth magnetic power coated with a heat resisting addition polymerizable thermosetting consisting essentially of a monomer or polymer of 2,2-bis(cyanatophenyl) propane together with a binder, as needed. In this case, a thermosetting resin such as epoxy resin can be used as the binder, and the magnetic powder is molded (agglomerated) into a compact having the desired shape by forming methods such as compression molding and the like.

After molding the compact, it is preferable to cure the thermosetting resin added as the binder and the heat resisting addition polymerizable thermosetting resin consisting essentially of a monomer or polymer of 2,2-bis(cyanatophenyl) propane at a temperature of not lower than 150° C. in a non-oxidizing atmosphere or in a vacuum. In the curing treatment, the thermosetting resin used as a binder is hardened, while the heat resisting addition polymerizable thermosetting resin consisting essentially of a monomer or polymer of 2,2-bis(-cyanatophenyl) propane is hardened by heating to form triazine rings therein. The triazine ring is remarkably stable to thermal energy, so that the heat resistance of the resin is improved.

In order to more uniformly coat the heat resisting addition polymerizable thermosetting resin consisting essentially of a monomer or polymer of 2,2-bis(-cyanatophenyl) propane onto the surfaces of the respective particles of the rare-earth magnetic powder, the curing is desirably carried out at a temperature of not lower than 150° C. in a vacuum. This is because the 2,2-bis(cyanatophenyl) propane resin is thereby temporarily vaporized and hardened after depositing on the surface of the rare-earth magnetic power in a very uniform manner.

For manufacturing the rare-earth bonded magnet in this manner, it is preferable as needed to add an organometallic salt such as zinc octylate, iron acetylacetonate or the like as a metallic catalyst together with the binder and the heat resisting addition polymerizable thermosetting resin. Namely, it is possible to further reduce the secular change of magnetic properties because adhesion between the rare-earth magnetic power and the heat resisting addition polymerizable thermosetting resin consisting essentially of a monomer or polymer of 2,2-bis(cyanatophenyl) propane is improved by addition of the organometallic salt as the metallic catalyst, and a firm coating film having good heat resistance can be obtained.

In the present invention, the rare-earth magnetic powder is coated with the heat resisting addition polymerizable thermosetting resin consisting essentially of a monomer or polymer of 2,2-bis(cyanatophenyl) propane on the surface thereof, and the coated magnetic power is used in this form. Consequently, it is possible to retard or prevent oxidation of the magnetic material, the heat resistance of the magnet is improved, and the secular change of the rare-earth bonded magnet at room temperature and above is remarkably reduced.

EXAMPLES

Example 1

First, by spraying a rare-earth molten magnetic alloy consisting essentially of 28 wt % of Nd; 0.9 wt % of B; 5.0 wt % of Co; Fe (remainder) on the surface of a copper roll rotating at the peripheral speed of 25 m/sec, a ribbon of about 30 μm in thickness was obtained, and a rare-earth magnetic powder was obtained by comminuting the ribbon to a size smaller than 200 μm. Subsequently, the rare-earth magnetic powder was annealed for 10 minutes at 550° C.

Next, epoxy resin which is a thermosetting resin was added to the annealed rare-earth magnetic power in an amount of 2 wt % of magnetic powder as a binder, and 2,2-bis(cyanatophenyl) propane which is the heat resisting addition polymerizable thermosetting resin was added to the magnetic power in the respective amounts shown in Table 1 below based on the weight of the magnetic power. Then, these components were mixed uniformly. Additionally, zinc octylate was further added to some of the samples as a metallic catalyst in an amount of 0.0006 wt % of the 2,2-bis(cyanatophenyl) propane resin content as indicated in Table 1.

Next, each of the mixed powders was compressed into a compact of 10mm in diameter and 7 mm in height, and cured for 1 hour at 170° C. in an atmosphere of argon.

Furthermore, rare-earth bonded magnets were obtained by polarizing the cured compacts in a pulse magnetic field of 50 kOe, and open flux values of the respective polarized magnets were measured. Additionally, the open flux values were measured again at room temperature after storage for 1000 hours at 180° C., whereby the rates of decrease of the open flux values, that is irreversible demagnetizing factors, were obtained. The results are shown in Table 1 together with the 2,2-bis(cyanatophenyl) propane resin (triazine resin) content.

TABLE 1

| Sample Number | Triazine resin content (wt %) | Irreversible demagnetizing factor (%) | |
|---|---|---|---|
| | | Without zinc octylate | Addition of zinc octylate |
| Conventional example | | | |
| 1 | 0 | 55.0 | 55.0 |
| Inventive example | | | |
| 2 | 0.01 | 38.0 | 32.5 |
| 3 | 0.05 | 27.5 | 20.6 |
| 4 | 0.10 | 10.8 | 9.9 |
| 5 | 0.20 | 9.4 | 8.4 |
| 6 | 0.30 | 8.5 | 7.3 |
| 7 | 0.50 | 8.2 | 7.3 |
| 8 | 1.00 | 8.9 | 8.2 |

AS shown in Table 1, in the case of conventional Example No. 1 which was not coated with 2,2-bis(cyanatophenyl) propane resin on the surface of the rare-earth magnetic power, the irreversible demagnetizing factor after storage for 1000 hours at 180° C. was considerably large. As compared with the above, in the case of Example Nos. 2 to 8 according to this invention which were coated with 2,2-bis(cyanatophenyl) propane resin, it was confirmed that the irreversible demagnetizing factor became considerably smaller when the 2,2-bis(cyanatophenyl) propane resin was coated in an amount of at least 0.01 wt %. However, it is not desirable to coat 2,2-bis(cyanatophenyl) propane resin in an amount greater than 2 wt % because the magnetic properties are degraded if this resin is coated in excess. In addition to the above, it was confirmed that the irreversible demagnetizing factor becomes smaller when an organometallic salt is added.

Example 2

By spraying a molton rare-earth magnetic alloy consisting essentially of 28 wt % of Nd; 0.9 wt % of B; 5.0 wt % of Co; Fe (remainder) on the surface of a copper roll rotating at the peripheral speed of 25 m/sec, a ribbon of about 30 μm in thickness was obtained, and a rare-earth magnetic powder was obtained by comminuting the ribbon to a size smaller than 200 μm. The thus obtained rare-earth magnetic power was annealed for 10 minutes at 550° C.

Secondly, an epoxy resin in an amount of 2 wt % based on the weight of the magnetic powder, which is a thermosetting resin, was added to the annealed rare-earth magnetic resin power as a binder, and 2,2-bis(cyanatophenyl) propane resin, which is the heat resisting addition polymerizable thermosetting resin (triazine resin), was added to the magnetic power in the amounts as indicated in Table 2 below based on the weight of the magnetic powder. Then, these powders were uniformly mixed similar to the case of Example 1. Furthermore, zinc octylate was also added to some of the samples as a metallic catalyst in an amount of 0.0006 wt % of the 2,2-bis(cyanatophenyl) propane resin content.

Next, each of the mixed powders was compressed into a compact of 10 mm in diameter and 7 mm in height, and the compacts were cured for 1 hour at 170° C. in a vacuum.

Then, the cured compacts were polarized in a pulse magnetic field of 50 kOe, and open flux values of each of the polarized magnets were measured. Additionally, the open flux values were measured again at room temperature after storage for 1000 hours at 180° C., whereby the rates of decrease of the open flux values, that is irreversible demagnetizing factors, were obtained. The results are shown in Table 2.

TABLE 2

| Sample Number | Triazine resin content (wt %) | Irreversible demagnetizing factor (%) | |
|---|---|---|---|
| | | Without zinc octylate | Addition of zinc octylate |
| Conventional example | | | |
| 9 | 0 | 53.5 | 53.5 |
| Inventive example | | | |
| 10 | 0.01 | 13.6 | 11.5 |
| 11 | 0.05 | 10.8 | 9.1 |
| 12 | 0.10 | 9.3 | 8.8 |
| 13 | 0.20 | 8.5 | 8.4 |
| 14 | 0.30 | 8.2 | 7.7 |
| 15 | 0.50 | 7.9 | 7.5 |
| 16 | 1.00 | 8.0 | 7.8 |

AS shown in Table 2, in the case of performing the curing in a vacuum, it was confirmed that the irreversible demagnetizing factor after storage for 1000 hours at 180° C. became smaller and the heat resistance of the magnet was further improved because the 2,2-bis(cyanatophenyl) propane resin was coated more uniformly on the respective surfaces of the magnetic powder.

Example 3

After obtaining a rare-earth magnetic powder consisting essentially of 31.1 wt % of Nd; 1.0 wt % of B; Fe (remainder) in the same manner as in Example 1, 2.0 wt % of epoxy resin based on the weight of the magnetic power as a binder and 0.3 wt % based on the weight of the magnetic powder of 2,2-bis(cyanatophenyl) propane resin (the heat resisting addition polymerizable thermosetting resin) were added to the annealed rare-earth magnetic power, and these components were mixed uniformly. In some of the samples, zinc octylate was further added as a metallic catalyst in an amount of 0.0006 wt % of the 2,2-bis(cyanatophenyl) propane resin content.

Next, each of the mixed powders was compressed into a compact of 10 mm in diameter and 7 mm in height. The compacts were cured for 1 hour at 170° C. either in the air, or in an atmosphere of argon, or in a vacuum as indicated in Table 3 below.

Then, the cured compacts were polarized in a pulse magnetic field of 50 kOe, and open flux values of each of the polarized magnets were measured. Additionally, the rates of decrease of the open flux values, that is irreversible demagnetizing factors, were obtained by measuring the open flux values at room temperature after storage for 1000 hours at 180° C. The measured results are shown in Table 3.

TABLE 3

| Sample Number | Triazine resin content (wt %) | Zinc octylate | Curing | Irreversible demagnetizing factor (%) |
|---|---|---|---|---|
| Conventional example | | | | |
| 17 | 0 | None | in Air | 32.5 |
| 18 | 0 | None | in Argon | 41.5 |
| 19 | 0 | None | in Vacuum | 49.0 |
| Inventive example | | | | |
| 20 | 0.3 | None | in Air | 4.9 |
| 21 | 0.3 | None | in Argon | 5.1 |
| 22 | 0.3 | None | in Vacuum | 3.5 |
| 23 | 0.3 | Addition | in Air | 4.4 |
| 24 | 0.3 | Addition | in Argon | 4.6 |
| 25 | 0.3 | Addition | in Vacuum | 3.0 |

As clearly seen from Table 3, conventional Example Nos. 17 to 19 which contained neither the 2,2-bis(cyanatophenyl) propane resin nor the organometallic salt showed large values of the irreversible demagnetizing factor after storage for 1000 hours at 180° C. As compared with the above, in Example Nos. 20 to 22 containing the 2,2-bis(cyanatophenyl) propane resin but no organometallic salt and Example Nos. 23 to 25 containing both the 2,2-bis(cyanatophenyl) propane resin and the organometallic salt, these samples showed considerably smaller values of the irreversible demagnetizing factor after storage for 1000 hours at 180° C. It was confirmed that the irreversible demagnetizing factor of a magnet cured in a vacuum is smaller than that of a magnet cured in the air or in an atmosphere of argon, and curing in a vacuum is effective for further improving the heat resistance of the magnet. Furthermore, it is clearly seen that it is possible to further decrease the irreversible demagnetizing factor by adding the organometallic salt as a metallic catalyst.

Example 4

An ingot having a composition represented by $Sm_2Fe_{17}$ was subjected to a homogenizing treatment by heating for 24 hours at a temperature of 1100° C., and grinding mechanically into a powder of the size passing through a 120 mesh. Then, the powder was subjected to nitriding by heating for 5 hours at a temperature of 550° C. in an atmosphere of nitrogen.

Secondly, a fine rare-earth magnetic powder was obtained by comminuting the nitrided powder into particles of 3 μm in mean diameter. Subsequently, to the rare-earth magnetic powder was added epoxy resin in an amount of 2 wt % as a binder, and 2,2-bis(cyanatophenyl) propane resin in an amount of 0.3 wt % (triazine resin) based on the weight of the magnetic powder was also added as the heat resisting addition polymerizable thermosetting resin. In some samples, iron acetylacetone was also added as a metallic catalyst in an amount of 0.0015 wt % of the 2,2-bis(cyanatophenyl) propane resin content.

Next, each of the mixed powders was compressed into a compact of 10 mm in diameter and 7 mm in height in a vertical magnetic field of 15 kOe, and the compacts were cured for 1 hour at 170° C., either in an atmosphere of argon or in a vacuum as indicated in Table 4 below.

The results shown in Table 4 were obtained by measuring the irreversible demagnetizing factors after storage for 1000 hours at 180° C. in the same manner as in Example 1.

The following were typical magnetic properties of these rare-earth bonded magnets; Br (residual magnetic flux density): 8.0 KG, iHc (coercive force): 8.5 kOe, (BH)max (maximum energy product): 11.8 MGOe.

TABLE 4

| Sample Number | Triazine resin content (wt %) | Iron acetylacetonate | Curing | Irreversible demagnetizing factor (%) |
|---|---|---|---|---|
| Conventional example | | | | |
| 26 | 0 | None | in Argon | 13.5 |
| Inventive example | | | | |

TABLE 4-continued

| Sample Number | Triazine resin content (wt %) | Iron acetyl-acetonate | Curing | Irreversible demagnetizing factor (%) |
|---|---|---|---|---|
| 27 | 0.3 | None | in Argon | 4.3 |
| 28 | 0.3 | None | in Vacuum | 2.5 |
| 29 | 0.3 | Addition | in Argon | 3.1 |
| 30 | 0.3 | Addition | in Vacuum | 2.0 |

As shown in Table 4, conventional Example No. 26 containing neither the 2,2-bis(cyanatophenyl) propane resin nor the organometallic salt showed large values of the irreversible demagnetizing factor after storage for 1000 hours at 180° C. As compared with the above, inventive Examples Nos. 27 and 28 containing the 2,2-bis(cyanatophenyl) propane resin but not the organometallic salt, and inventive Examples Nos. 29 and 30 containing both the 2,2-bis(cyanatophenyl) propane resin and the organometallic salt showed considerably smaller values of the irreversible demagnetizing factor after storage for 1000 hours at 180°0 C. It was confirmed that the irreversible demagnetizing factor became smaller in the case of curing in a vacuum, and that it is effective to carry out the curing in a vacuum for further improving the heat resistance of the magnet. Additionally, it was also confirmed that it is possible to further decrease the irreversible demagnetizing factor by adding an organometallic salt as a metallic catalyst.

As discussed above, in accordance with this invention, it is possible to prevent oxidation of the rare-earth magnetic powder which is very readily oxidized in itself. Furthermore, the long term (i.e., secular) change of magnetic properties of the rare-earth bonded magnet at room temperature and at temperatures higher than room temperature becomes smaller. Accordingly, an excellent effect can be obtained by providing a rare-earth bonded magnet having improved heat resistance.

It should further be apparent to those skilled in the art that various changes in form and detail of the invention as shown and described above may be made. It is intended that such changes be included in the spirit and scope of the claims appended hereto.

What is claimed is:

1. A composition for a rare-earth bonded magnet comprising a rare-earth magnetic powder coated with a heat resisting addition polymerizable thermosetting material consisting essentially of a monomer or polymer of 2,2-bis(cyanatophenyl) propane in an amount of not more than 2 wt % based on the weight of the magnetic powder.

2. The composition of claim 1, wherein the rare-earth magnetic powder is coated with the heat resisting addition polymerizable material in an amount of from 0.01–1.00 wt % based on the weight of the magnetic powder.

3. A rare-earth bonded magnet prepared by agglomerating a rare-earth magnetic powder coated with a heat resisting addition polymerizable thermosetting material consisting essentially of a monomer or polymer of 2,2-bis(cyanatophenyl) propane in an amount of not more than 2 wt % based on the weight of the magnetic powder together with a binder.

4. The rare-earth bonded magnet of claim 3, wherein the rare-earth magnetic powder is coated with the heat resisting addition polymerizable material in an amount of from 0.01–1.00 wt % based on the weight of the magnetic powder.

5. The rare-earth bonded magnet of claim 3, prepared by agglomerating a rare-earth magnetic powder coated with a heat resisting addition polymerizable thermosetting material consisting essentially of a monomer or polymer of 2,2-bis(cyanatophenyl) propane in an amount of not more than 2 wt % based on the weight of the magnetic powder together with a binder and a metallic catalyst comprising an organo metallic salt.

* * * * *